US007128030B2

(12) United States Patent
Gschwend et al.

(10) Patent No.: US 7,128,030 B2
(45) Date of Patent: Oct. 31, 2006

(54) COMBUSTION-ENGINED SETTING TOOL

(75) Inventors: Hans Gschwend, Buchs (CH); Kaveh Towfighi, Sigmarszell (DE); Lothar Voelker, Sax (CH); Ulrich Schiestl, Feldkirch (AT); Iwan Wolf, Chur (CH); Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 400 days.

(21) Appl. No.: 10/743,160

(22) Filed: Dec. 22, 2003

(65) Prior Publication Data

US 2004/0187810 A1 Sep. 30, 2004

(30) Foreign Application Priority Data

Dec. 23, 2002 (DE) ..... 102 60 703

(51) Int. Cl.
*F02B 71/00* (2006.01)

(52) U.S. Cl. ..... 123/46 H; 227/10

(58) Field of Classification Search ..... 123/460, 123/438, 46 H; 227/10, 12
See application file for complete search history.

(56) References Cited

U.S. PATENT DOCUMENTS 6,260,519 B1 * 7/2001 Phillips ..... 123/46 R
6,722,548 B1 * 4/2004 Odoni et al. ..... 227/8
6,877,308 B1 * 4/2005 Voelker et al. ..... 60/39.6

* cited by examiner

*Primary Examiner*—Tony M. Argenbright
*Assistant Examiner*—Katrina Harris
(74) *Attorney, Agent, or Firm*—Abelman, Frayne Schwab

(57) ABSTRACT

A combustion-engined setting tool for driving fasting elements such as nails, bolts, pins in an object, includes a combustion chamber (13), a fuel source (11), a fuel conduit (12) connecting the fuel source (11) with combustion chamber (13) for feeding fuel thereinto, and at least one metering device (30) for metering a predetermined amount of fuel for effecting a setting process and having at least one variable volume metering chamber (31), and a displaceable piston body (34) for a pulsed ejection of fuel from the metering chamber (31).

13 Claims, 6 Drawing Sheets

44
50
54
30
66
55.1
54.1
61.1
55
75
53
34.1
52
61
73
28.1
56
70
71
36
59.1
59
40
69
37
34
31
39
32
32
(12)
62
38.1
59
58
33
67
36.1
68
63
74
72
35
60.1
64
60
65
33
80

30
66
50
51
75
57
61
52
73
34.1
36
71
28.3
70
56
69
37
34
39
(12)
38.3
31
36.1
72
74
35
60
65
33
80

COMBUSTION-ENGINED SETTING TOOL

BACKGROUND OF THE INVENTION

1. Field of the Invention

The present invention relates to a combustion-engined setting tool for driving fastening elements such as nails, bolts, pins in an object and including a combustion chamber, a fuel source, a fuel conduit connecting the fuel source with the combustion chamber for feeding fuel thereinto, and at least one metering device for metering a predetermined amount of fuel for effecting a setting process and including at least one metering chamber having an adjustable volume.

2. Description of the Prior Art

Combustion-engined setting tools of the type described above can operate with a gaseous or liquid fuel that is combusted in the combustion chamber generating pressure for driving the drive piston which drives a fastening element in.

Generally, the problem with combustion consists in admixing, to a proportional amount of fuel for each operational cycle, a corresponding amount of air or oxygen used as an oxidation medium. The amount of oxygen, which is available for use in combustion, depends very much on the surrounding temperature, air pressure, and air humidity. The necessary amount of fuel varies greatly with changes in the above-listed parameters, up to 40% in an extreme case. These variations of the amount of fuel unfavorably influence the combustion of the air-fuel mixture when the fuel-air mixture contains too much or too little fuel. Therefore, it is desirable to adapt the used amount of fuel to the respective environmental conditions. In order to achieve an optimal combustion, it is further desirable to inject the fuel into the combustion chamber with as high a speed as possible.

European Publication EP-1 254 745 A2 discloses a setting tool of the type discussed above and having a metering valve in which the volume of the metering chamber is adjusted with a spindle projecting into the metering chamber. For changing and preliminary setting the inner volume of the metering chamber, the spindle is displaced into the metering chamber to a greater or lesser degree. The displacement of the spindle is effected manually by screwing the spindle in or out of the metering chamber. The feeding of fuel to the combustion chamber is effected through an outlet valve under the own pressure of the fuel filling the metering chamber.

European Patent EP-0 597 241 B1 disclosed a combustion-engined setting tool in which a metering device is used for feeding fuel from a fuel source to a combustion chamber. The metering device includes a normally closed solenoid valve. The actuation of the valve is effected electronically and is controlled by a switching circuit. The switching circuit responds to actuation of a switch and opens the valve in a predetermined time interval to provide for flow of fuel from the fuel source to the combustion chamber.

The drawback of the setting tool of EP-0 597 241 B1 consists in that with variations of the pressure in the fuel source the flow velocity of the fuel varies and can result in a non-exact amount of fuel fed to the combustion chamber. The flow of fuel into the combustion chamber takes place under the fuel own pressure.

German Publication DE-42 43 617 A1 discloses a setting tool in which in an operational cycle, a gas inlet valve opens mechanically, and fuel from a fuel source is fed into a storage chamber which communicates with the surrounding air. This communication provides for a pressure and, if necessary, temperature equalization with the surrounding air, whereby a proper air-fuel mixture is fed into the combustion chamber. The fuel is fed from the storage chamber and to the combustion chamber at a predetermined time.

The drawback of the setting tool of DE-42 43 617 A1 consists in that the communication with the surrounding air can cause loss of fuel. Further, the pressure in the metering chamber cannot be controlled.

The object of the present invention is to provide a setting tool of the type described above in which the drawbacks of the prior art tools are eliminated, and an exact metering of full is insured.

Another object of the present invention is to provide a setting tool of the type described above and in which a high setting energy is achieved.

SUMMARY OF THE INVENTION

These and other objects of the present invention, which will become apparent hereinafter, are achieved by providing a metering device that in addition to means for adjusting a metering chamber volume for metering the predetermined amount of fuel, includes a displaceable piston body for a pulsed ejection of fuel from the metering chamber.

With a displaceable piston body ejecting fuel from the metering chamber, the inner volume of the metering chamber is reduced to zero upon ejection of the fuel. The displaceable piston body insured ejection of fuel from the metering chamber with a high speed. The solution according to the present invention provides a direct injection system that meters the fuel under a high pressure through one or several fine nozzles into the combustion chamber. An advantage of the invention further consists in that the ejected, through the pumping valve, spray having a high turbulence and very fine drops permits to obtain a high evaporation rate even of fuel with a low-boiling point, which provides for a favorable cold temperature behavior of the setting tool.

According to an advantageous embodiment of the present invention, the initial volume of the metering chamber is pre-adjusted by adjusting the initial position of the displaceable piston body.

According to another advantageous embodiment of the present invention, the metered volume of the metering chamber is adjusted with an adjustment device. The metering chamber volume in the initial position of the metering device is determined by an axial distance between a static body and a bottom of the oppositely located displaceable piston body. The adjustment device adjusts or changes the axial distance between the static body and the displaceable piston body in the initial position of the metering device. In this way, the displaceable piston body, the "ejection body" performs a double function, which simplifies the structure of the metering device.

According to one of preferred embodiments of the inventive setting tool, it includes sensor means, e.g., for sensing the surrounding temperature. The sensor means can cooperate with the adjustment device of the metering device, so that the adjustment device adjusts the metering chamber volume, e.g., dependent on the temperature sensed by the sensor means, by adjusting the position of the displaced piston body relative to the static body. This permits to feed into the combustion chamber an optimal fuel-air mixture corresponding to the temperature of the surrounding air.

According to another preferred embodiment of the present invention, the adjustment device is operated manually, with use of an adjusting screw. The manual operation is effected by a tool user who adjust the position of the adjusting screw, e.g., according to a cold or warm operation.

According to yet another advantageous embodiment of the present invention, there can be provided sensor means that senses in addition to the surrounding temperature, other environmental parameters and the parameters of the power tool such as, e.g., the temperature of the combustion chamber. The obtained measurement data or parameters are transmitted by the sensor means to a control device which, in turn, transmits appropriate commands to the adjustment device. The control device controls the metering device dependent on the obtained data for obtaining an optimal air-fuel mixture.

According to a further advantageous embodiment of the present invention, the displaceable piston body has opposite end surfaces which are subjected to hydraulic pressure and/or pneumatic pressure. By applying the hydraulic or pneumatic pressure to a respective end surface, the displaceable piston body is displaced in a pulsed manner, ejecting the fuel from the metering chamber with high speed. For obtaining the hydraulic and/or pneumatic pressure, there is provided hydraulic and/or pneumatic means which communicates with respective piston chambers, providing for application of pressure to the respective end surface. The hydraulic or pneumatic means can be controlled by the control device or a separate switch.

The metering chamber can have an inlet, an outlet, and valve means provided at the inlet and the outlet and allowing flow of fuel only in a direction to the combustion chamber. This insures an error-free operation of the metering device.

According to a still further advantageous embodiment of the present invention, the displaceable piston body is formed as a pot-shaped piston a pot space of which forms the metering chamber and serves for sealingly receiving the static body. The static body functions as a displacement body through which the fuel volume, which fills the pot space or the metering chamber, can be ejected. To this end, an axial through-channel is formed in the static body and an end of which remote from the metering chamber forms an outlet of the metering device. Advantageously, the outlet has a nozzle opening, or a nozzle is provided thereat. The fuel, which is ejected through the through-channel, is injected into the combustion chamber through the nozzle opening or nozzle, e.g. in form of a fine mist.

Advantageously, valve means for controlling flow through the axial through-channel is provided at the opening of the through-channel adjacent to the metering chamber. The valve means includes a valve rod displaceable through a passage formed in the displaceable piston body and its pot space and having a valve head, and a valve seat provided at the adjacent opening for sealingly receiving the valve head. In the initial position of the metering device, the valve seat, together with the valve had, insure an absolute tightness against any leakage of the fuel so that no fuel can penetrate into the combustion chamber before actuation of the metering device.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
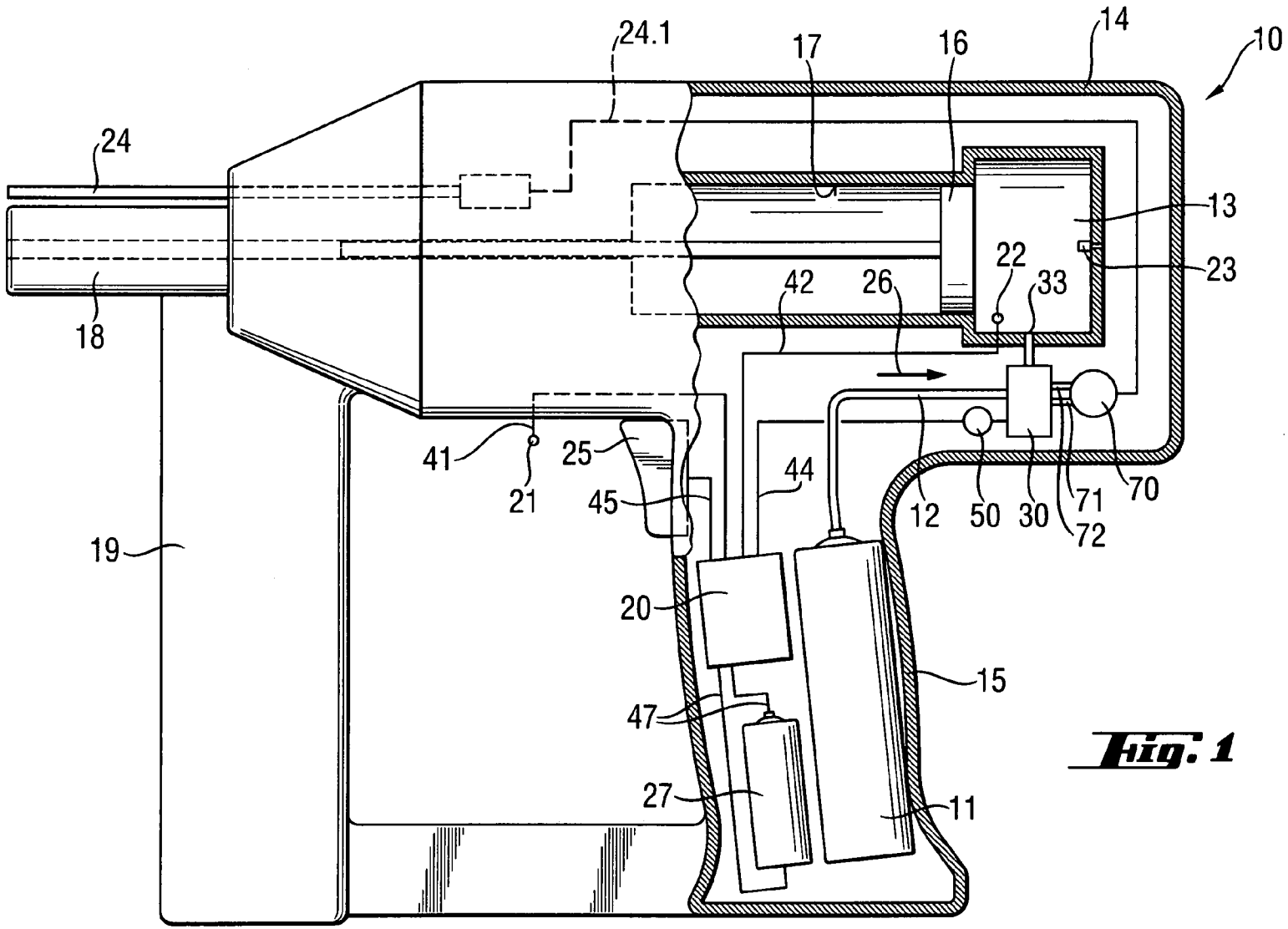
FIG. 1 side partially cross-sectional view of a combustion engined setting tool according to the present invention.

A combustion-engined setting tool 10 according to the present invention and which is shown in FIG. 1, is shown in its initial or inoperative position. The setting tool 10 is driven by a fuel gas. The setting tool 10 has a housing 14 in which a setting mechanism is arranged. The setting mechanism is designed for driving a fastening element (not shown) in an object (likewise not shown) when the setting tool is pressed against a constructional component or an object and is actuated. The setting tool 10 includes a combustion chamber 13, a piston guide 17 which adjoins the combustion chamber 13 and in which a drive piston 16 is displaceably arranged, and a bolt guide 18 adjoining the piston guide 17 and in which a fastening element is received. The fastening element is driven in a constructional component or an object by the front, in a setting direction, end of the drive piston 16 when the drive piston 16 is displaced in a setting direction. The fastening elements can be stored, e.g., in a magazine 19 attachable to the setting tool 10.

An ignition device, e.g., a spark plug 23 is arranged in a combustion chamber 13 for igniting a fuel gas-air mixture which is fed into the combustion chamber 13. The fuel gas is fed into the combustion chamber 13 from a fuel reservoir of fuel source 11 through a fuel conduit 12. The feeding direction of the fuel gas from the fuel reservoir 11 to the combustion chamber 13 is shown in FIG. 1 with arrow 26.

Figure 2:
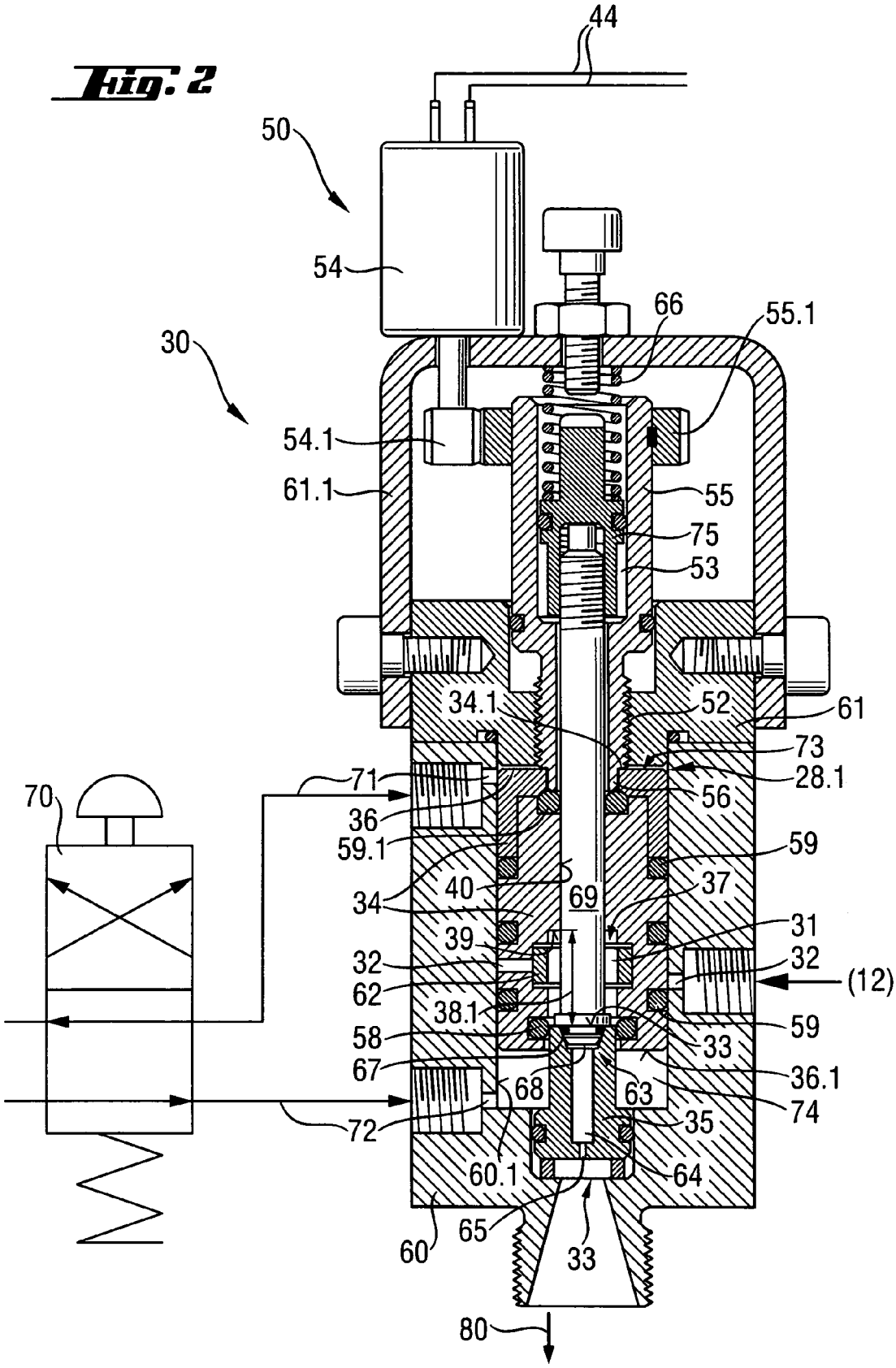
FIG. 2 a cross-sectional view of the metering device of the setting tool shown in FIG. 1 with a metering chamber having a first initial position and with an electronically actuated adjustment device for adjusting the metering chamber volume.

A metering device 30 is arranged in the fuel conduit 12. A detailed view of the metering device 30 is shown in FIG. 2.

The setting tool 10 further includes an electronic control device 20 which is connected with a current source 27 such as, e.g., a battery or an accumulator, by an electrical conductor 47.

The control device 20 can, e.g., include a microprocessor in which a control program for one or several tool functions can be run. The control device 20 can control the metering of fuel by controlling operation of an adjustment device 50 for the metering device 30. The fuel is fed from the metering device 30 into the combustion chamber 13 in form of a mist when the metering device 30 is actuated by an actuation device 70, e.g., pneumatic valve means. The actuation device 70 can itself be actuated by the control device 20 and/or a separate switch means 24 such as, e.g., a bar-shaped end switch connected with the actuation device 70 by an electrical conductor 24.1 or a mechanical bar.

The control device 20 is connected with the adjustment device 50 by an electrical conductor 44. An electrical conductor (not shown) connects the control device 20 with the spark plug 13. Switch means or a trigger switch 25 is provided on a handle 15 of the setting tool 10 and is connected with the control device 20 by an electrical conductor 45. The trigger switch is actuated electronically. The control device 20 is adapted to process measurement data and parameters of different sensors, such as, e.g., a sensor 21 for sensing the air pressure and the temperature of the surrounding air and a sensor 22 for sensing the temperature in the combustion chamber 13. Electrical conductors 41, 42 connect the sensors 21, 22 with a control device 20. The electrical conductors 41, 42, 44, 45, 47 are used for both supplying the electrical power and for an electronic data transmission. Besides the sensors 21 and 22, other sensors can be provided for sensing and transmitting measurement data to control device 20. The other sensors can, e.g., be used for determining parameters of the setting tool such as, e.g., positions of the piston.

FIG. 2 shows in detail a first embodiment of a metering device 30 according to the present invention. The metering device 30 has a housing part 60 including a receiving chamber 60.1 in which a body 34 formed as a pot-shaped piston is body displaceably arranged. The piston body 34 is sealed against the housing part 60 with seals 59. Further, in the reduced diameter region of the receiving chamber 60.1, a static body 35 is located. The static body 35 is received in a pot-shaped space 37 of the piston body 34 and is sealed at its edge against the pot-shaped space 37 with a seal 58, e.g., an O-ring. In the initial position of the metering device 30 shown in FIG. 2, the displaceable piston body 34 is located in its initial position 28.1 in which its end remote from the static body 35 abuts a further housing part 61 that closes the receiving chamber 60.1. In the initial position of the metering device 30, a metering chamber 31 is formed between a bottom 39 of the pot-shaped space 37 and the static body 35 and the volume of which is defined by an axial distance 38.1 between the bottom 39 and the edge region of the static body 35. In the initial position of the metering device 30, through an inlet 32, to which the fuel conduit 12 is connected, the fuel, e.g., in a liquid form, can be fed into the metering chamber 31. A valve 62, which is formed, in the embodiment shown in FIG. 2, as a resilient annular member, provides for flow of fuel through the inlet 32 in the metering chamber 31 but prevents a return flow of fuel from the metering chamber 31 through the inlet 32.

The static body 35 has an axial through-channel 64 having at its end adjacent to an outlet 33 which communicates with the combustion chamber 13, an injection opening 65 the cross-section of which is reduced in comparison with the through-channel 64. The injection opening 65 is designed for obtaining a fine fuel mist when the fuel is ejected under pressure from the metering chamber 31 upon initiation of a setting process. A valve 63 separates the metering chamber 31 from the through-channel 64 and the outlet 33. The valve 63 is formed of a valve body 69, e.g., a valve rod and a valve head 68 that sealingly engages a valve seat 67 provided in the static body 35. In the initial position of the metering device 30, which is shown in FIG. 2, the valve 63 occupies a closed position in which the valve head 68 is engaged in the valve seat 67, whereby the through-channel 64 is closed. The valve body 69 is axially displaceable in the pot-shaped space 37 in a passage 40 formed in the displaceable piston body 34. A seal 59.1 seals the valve body 69 against the passage 40. The valve body 69 is supported at its end remote from the valve seat 67 by a spring 66 against a housing part 61.1 of the metering device 30. The spring 66 retains the valve body 69 in its closing position.

For adjusting the interior volume of the metering chamber 31 in the initial position of the metering device 30, the metering device 30 is associated with the adjustment device 50. The adjustment device 50 has, in the embodiment shown in the drawings, a drive 54 which is controlled by the control device 20 through control conductors 44. The drive 54 drives a gear 54.1 that is engaged with a gear 55.1 mounted on an adjustment member 55, whereby the adjustment member 55 rotates upon actuation of the drive 54.

Screw actuator means 52, which is located in the housing part 61, axially displaces the adjustment member 55 when the adjustment member is set in rotation. The adjustment member 55 displaces, upon being axially displaced, the displaceable piston body 34, acting with its end region 56 on stop means 34.1 on the piston body 34. As a result, the piston body 34 can continuously be displaced to different initial positions.

For a pulsed operation the metering device 30, the actuation device 70 is provided, which is formed as a pneumatic valve. From a pressure medium source, a pressure medium, e.g., compressed air is supplied to this pneumatic valve. Opposite operational surfaces 36 and 36.1 of the displaceable piston body 34 are subjected to the action of the pressure medium that is communicated thereto via connection conduits 71 and 72 which communicate the pressure medium to respective piston chambers 73 and 74. In the position of the metering device 30 shown in FIG. 2, the piston chamber 73, which is associated with the operational surface 36, is reduced to a size of a slot, because in the initial position of the metering device 30, the metering chamber 31 has a maximal axial extent. The connection conduit 71, which is connected with the piston chamber 73, is aerated and remains pressureless in the initial position of the metering device 30. The connection conduit 72, which communicates with the piston chamber 74 associated with the operational surface 36.1, remains under pressure or is pressurized, retaining the displaceable piston body 34 in its initial position 28.1. The operation of the pneumatic valve will be discussed in detail further below with reference to FIGS. 4–6.

Figure 3:
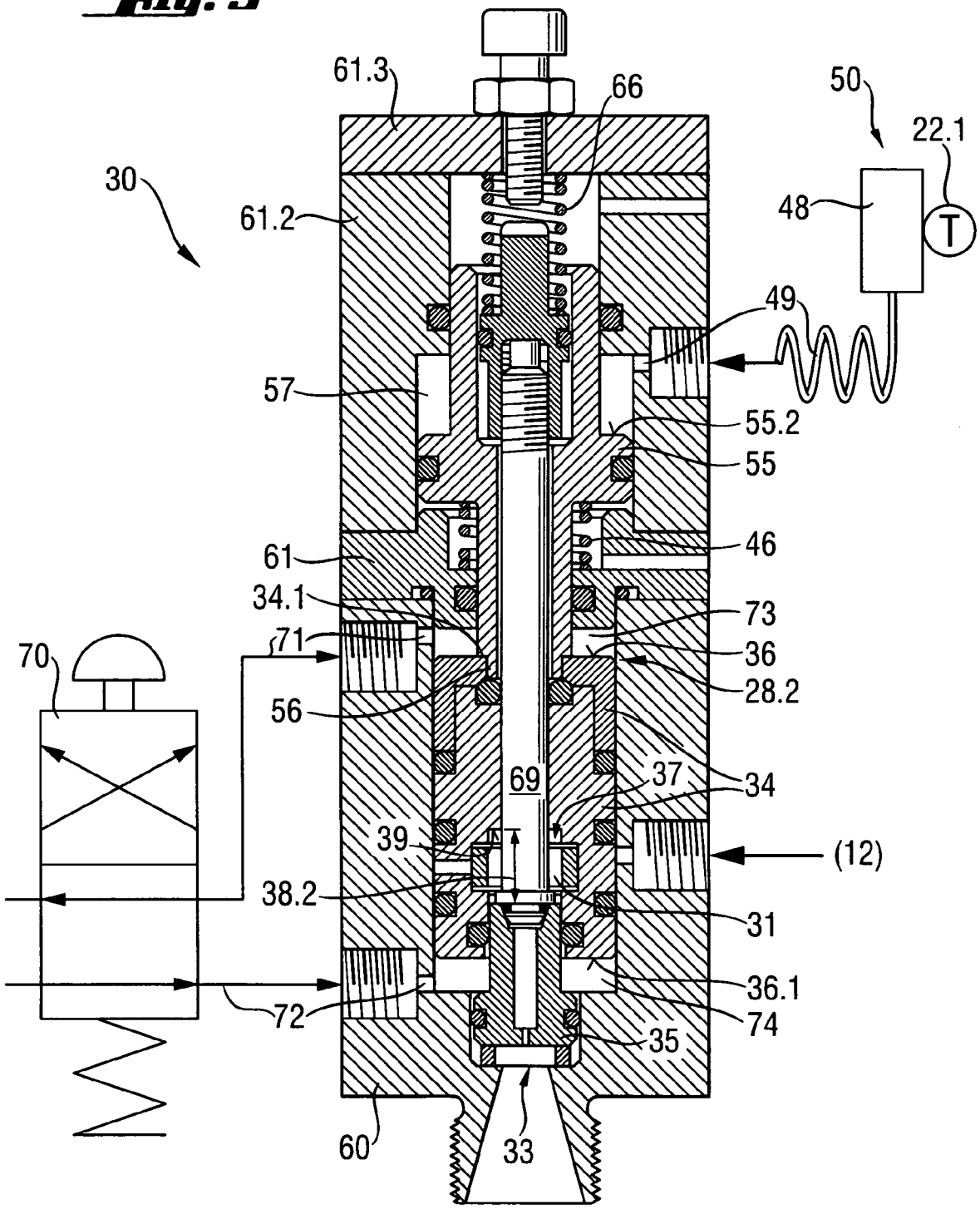
FIG. 3 a cross-sectional view of the metering device of the setting tool shown in FIG. 1 with a metering chamber having a second initial position and with a hydraulic adjustment device for adjusting the metering chamber volume.

Another embodiment of a metering device according to the present invention is shown in FIG. 3. In FIG. 3, the same elements are designated with the same reference numerals. The metering device shown in FIG. 3 differs from the metering device shown in FIG. 2 in that it includes a different adjustment device 50. The adjustment device 50 of the metering device 30 shown in FIG. 3 has, instead of motor drive, a hydraulic device for a preliminary adjustment of the initial position of the displaceable piston body 34. The adjustment device 50 includes an adjustment member 55 with an end surface 55.2 arranged in a piston chamber 57 of a housing part 61.2 of the metering device 30. The piston chamber 57 is connected by an opening 49 with a reservoir 48 for a hydraulic medium. On the reservoir 48, sensor means 22.1 for sensing, e.g., the temperature of the environmental air, are mounted. Dependent on the temperature of the surrounding air, a greater or lesser amount of the hydraulic medium is fed from the reservoir 48 through the opening 49 into the piston chamber 57. The hydraulic medium in the piston chamber 57 acts on the end surface 55.1 of the adjustment member 55, displacing the adjustment member 55 against a biasing force of a spring 46 to a desired initial position. The adjustment member 55 has an opposite end region 56 which acts against a stop 34.1 which is provided on the displaceable piston body 34, for displacing the piston body 34.

The piston body 34 is subjected in its initial position 28.2 to action of the pressure medium which is communicated by the actuation device 70 through the conduit 72 into the piston chamber 74 and which acts on the end surface 36.2, retaining the piston body 34 in engagement with the end region 56 of the adjustment member 55.

In the embodiment of the metering device 30 shown in FIG. 3, the housing part 61.2 is closed with a cover 61.3. The cover 61.3 supports a spring member 66 for biasing the valve body 69 to its closing position. In the initial position 28.2 of the displaceable piston body 34, the axial distance 38.2 between the bottom 39 of the metering chamber 31 and the static body 35 is significantly reduced in comparison with the same distance in FIG. 2. Therefore, the inner volume of the metering chamber 31 in the metering device 30 shown in FIG. 3 is smaller than that of the metering chamber 31 in the metering device 30 shown in FIG. 2.

When the sensor means 22.1 senses a very cold temperature, the hydraulic medium would flow through the conduit 49 back into the reservoir 48, and as a result of lifting of the adjustment body 55, the displaceable piston body would displace to its original initial position shown in FIG. 2, with the metering chamber 31 having its maximum volume. It is to be noted that the displaceable piston body 34 can occupy a plurality of different initial positions. For particularities and functions of elements of the metering device 30 shown in FIG. 3 and not described above reference should be made to particularities and functions of identical elements of the metering device 30 shown in FIG. 2 which were described with reference to FIGS. 1 and 2.

Figure 4:
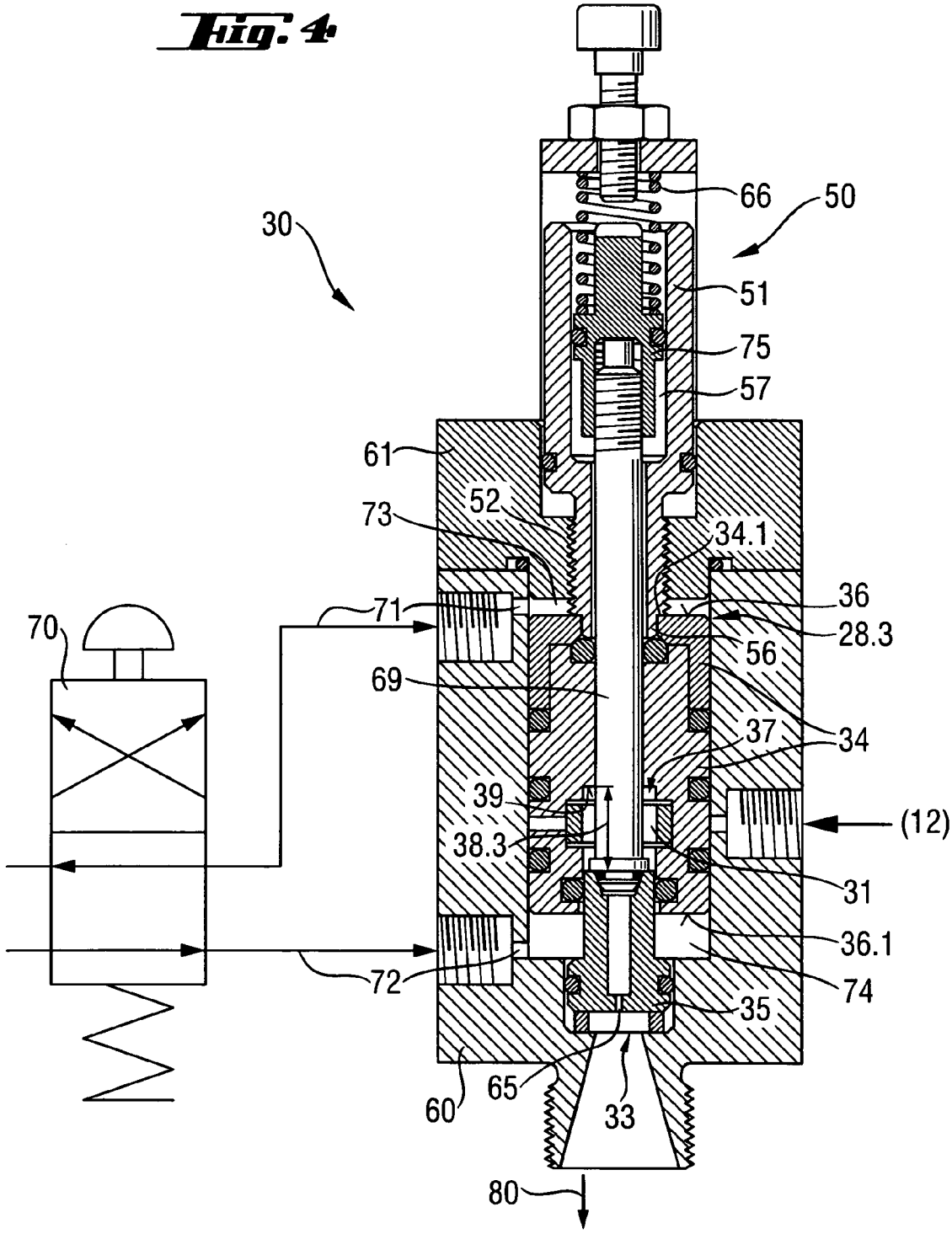
FIG. 4 a cross-sectional view of the metering device of the setting tool shown in FIG. 1 with a metering chamber having a third initial position and with a manually actuated adjustment device for adjusting the metering chamber volume.

FIG. 4 shows a further embodiment of a metering device 30 according to the present invention. In FIG. 4, the elements of the metering device 30 identical to elements of the metering devices 30 shown in FIGS. 2–3 are designated with the same reference numerals. The metering device 30 shown in FIG. 4 differs from those shown in FIGS. 2–3 again by the construction of the adjustment device. The adjustment device 50 includes an adjusting screw 51 which is manually set by a power tool user. The adjusting screw 51 is set by being rotated by the power tool user. The adjusting screw 51 has an outer thread that cooperates with an inner thread 52 provided in the housing part 61. The set position of the adjusting screw 51 determines the position of the displaceable piston body 34 in the receiving chamber of the housing part 60. The position of the displaceable piston body 34 determines an axial distance 38.3 between the bottom 39 and the metering chamber 31 and the static body 35. In a head region of the cylindrically shaped adjusting screw 51, there is provided a piston chamber 57 in which a piston 75 is arranged. As shown in FIG. 4, the displaceable piston body 34 is located in an initial position 28.3 in which the metering chamber 31 has a volume intermediate between the volumes of the metering chambers 31 of the metering devices 30 shown in FIGS. 2 and 3. For other particularities and functions of the metering device 30 shown in FIG. 4, reference should be made to the description made with reference to FIGS. 1–3.

Figure 5:
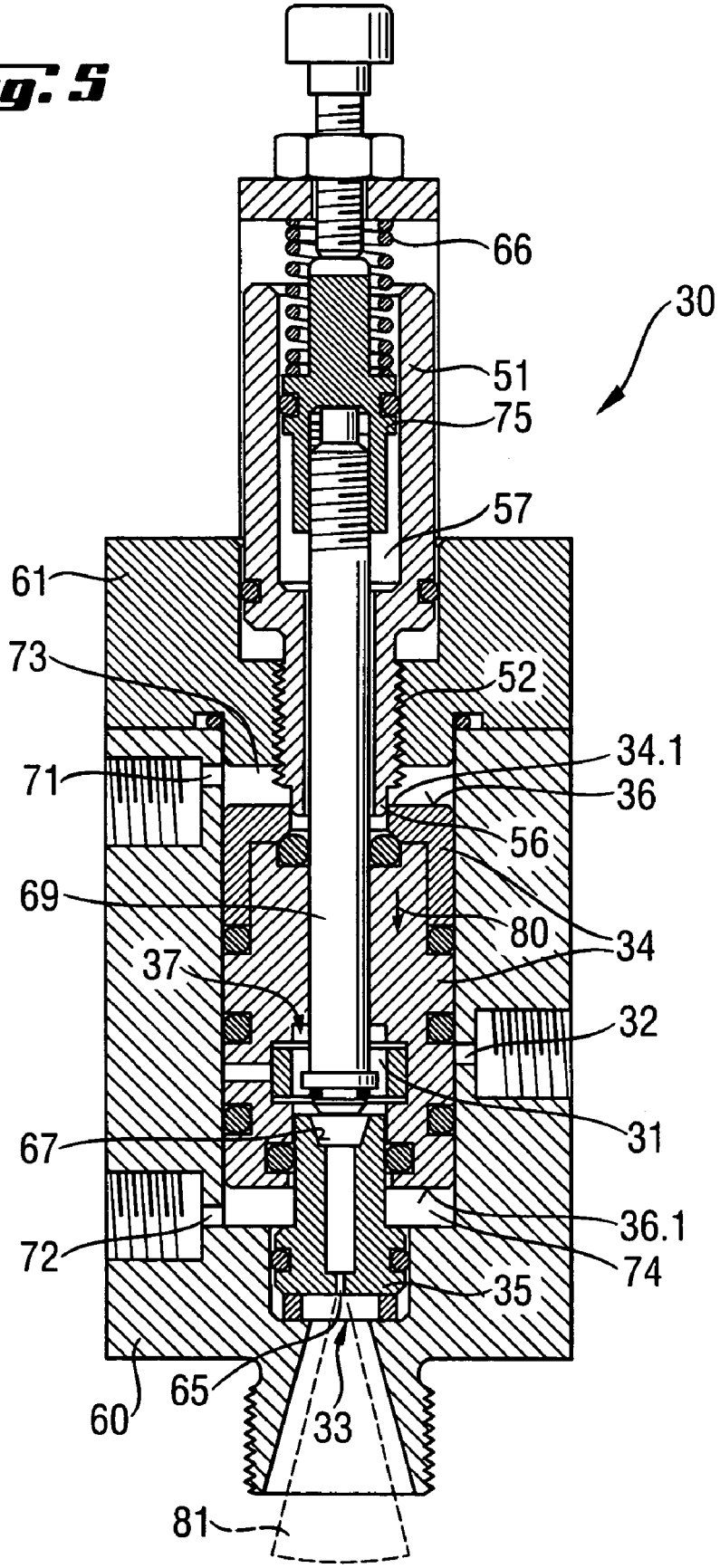
FIG. 5 a cross-sectional view of the metering device shown in FIG. 4 in an intermediate position.

For actuating the metering device 30, the actuation device 70 is actuated, whereby the conduit 71 is pressurized, and the conduit 72 is depressurized. With pressurization of the conduit 71 and depressurization of the conduit 72, the displaceable piston body 34 is intermittently displaced in the direction shown with arrow 80. The intermediate position of the displaceable piston body 34 is shown in FIG. 5. The pot-shaped space 37 overruns the static body 35, which leads to almost a complete ejection of the fuel which fills the metering chamber 31, from the metering chamber. Before the start of the ejection process, the piston 75, which is located in the piston chamber 57 of the adjusting screw 51, is displaced, together with the valve rod 69, in a direction opposite the closing direction of the valve rod 69 and against the biasing force of the spring 66, whereby the valve rod 69 is lifted off the valve seat 67. The lifting of the valve rod 69, opens the outlet 33, and the fuel mist 81 is ejected through the nozzle opening 65 and through the outlet 33.

Figure 6:
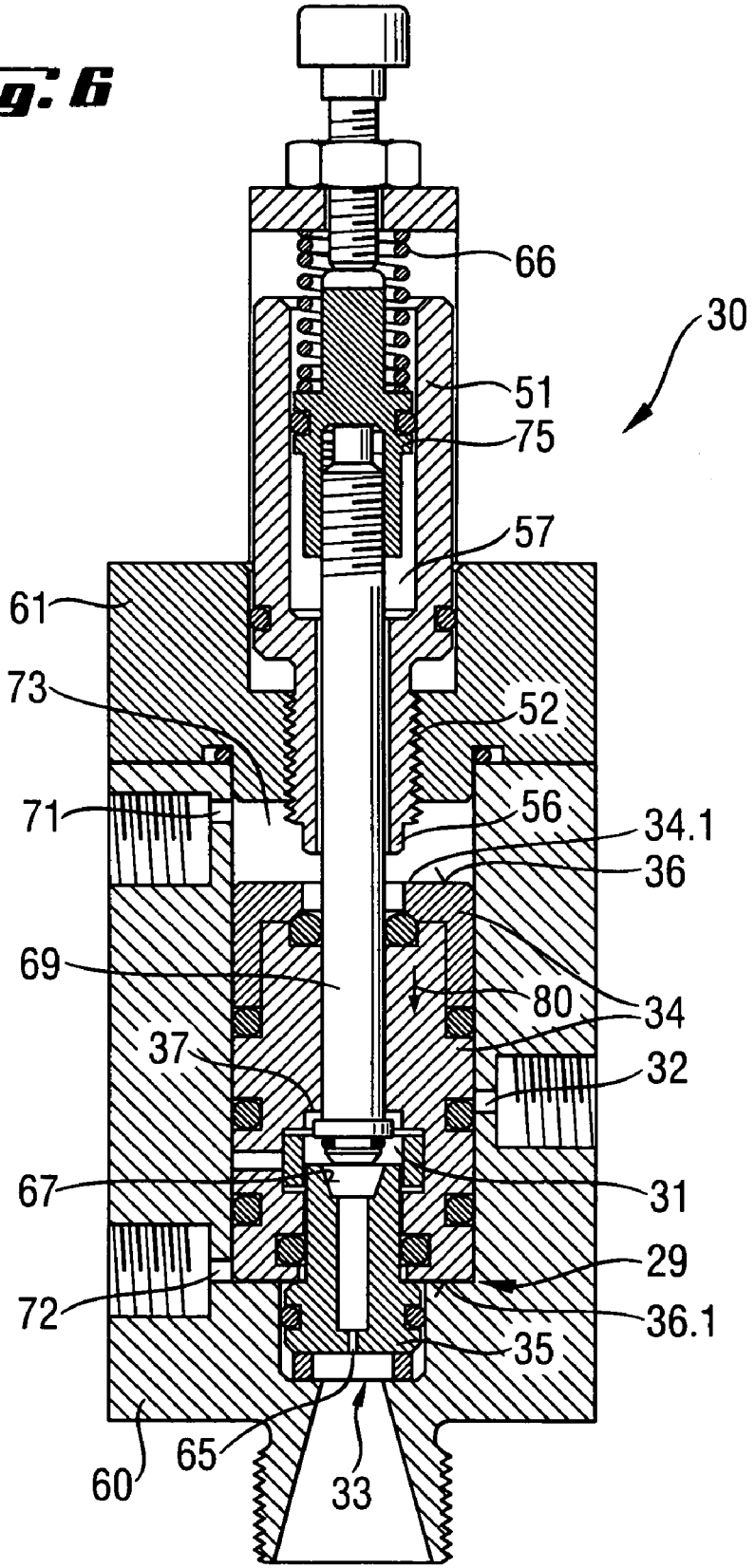
FIG. 6 a cross-sectional view of the metering device shown in FIG. 4 in its end position.

FIG. 6 shows the position of the displaceable piston body 34 of the metering device 30 in its end position 29. In this position of the piston body 34, the volume of the piston chamber 74 (see FIG. 5) is zero, and the metered volume of the fuel has almost completely been ejected from the metering chamber 31 through the nozzle opening 65 and delivered to the combustion chamber 13. For returning the piston body 34 to its initial position, the conduit 71 is depressurized by the actuation device 70, and the conduit 72 is pressurized, and a new injection cycle can be initiate again.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claimed is:

1. A combustion-engined setting tool for driving fastening elements in an object, comprising a combustion chamber (13); a fuel source (11); a fuel conduit (12) connecting the fuel source (11) with the combustion chamber (13) for feeding fuel thereinto; and at least one metering device (30) for metering a predetermined amount of fuel for effecting a setting process, the at least one metering device (30) including at least one metering chamber (31); means for adjusting a metering chamber volume for metering the predetermined amount of fuel, and a displaceable piston body (34) for a pulsed ejection of fuel from the metering chamber (31).

2. A setting tool according to claim 1, wherein the metered chamber volume is adjusted by adjusting an initial position (28.1, 28.2, 28.3) of the displaceable piston body (34).

3. A setting tool according to claim 2, wherein the metering device (30) comprises a static body (35), and the metering chamber (31) is enclosed between the displaceable piston body (34) and the static body (35), and wherein adjusting means comprises an adjustment device (50) for adjusting the initial position of the displaceable piston body (34).

4. A setting tool according to claim 3, further comprising means (22.1) for sensing temperature of a surrounding air and cooperating with the adjustment device (50).

5. A setting tool according to claim 3 wherein the adjustment device (50) is manually operable.

6. A setting tool according to claim 5, wherein the manually operable adjustment device (50) comprises an adjusting screw (51).

7. A setting tool according to claim 1, further comprising a control device (20) for the metering device (30); and sensor means for sensing at least one of parameters of the setting tool and of environment and for communicating the at least one parameter to the control device (20), the control device (20) providing for adjustment of a volume of the metering chamber (31) for each operational cycle dependent from the sensed, at least one parameter.

8. A setting tool according to claim 1, wherein the displaceable piston body (34) has opposite end surfaces (36, 36.1) which are subjected to at least one of hydraulic pressure and pneumatic pressure, the piston body (34) being displaced in a pulsed manner upon the at least one of the hydraulic pressure and the pneumatic pressure acting on a respective one of the end surfaces (36, 36.1).

9. A setting tool according to claim 8, further comprising actuation means (70) formed as at least one of hydraulic valve means and pneumatic valve means for subjecting the opposite end surfaces (36, 36.1) to the at least one of hydraulic pressure and the pneumatic pressure, respectively; and at least one of a control device (20) and a switch (24) for controlling the actuation means (70).

10. A setting tool according to claim 3, wherein the metering chamber (31) has an inlet (32) and an outlet (33), and valve means (62, 63) provided at the inlet (32) and the outlet (33), the valve means (62, 63) providing for flow of fuel only in a direction to the combustion chamber (13).

11. A setting tool according to claim 3, wherein the displaceable piston body (34) is formed as a pot-shaped piston a pot space (37) of which forms the metering chamber and is formed for sealingly receiving the static body (35).

12. A setting tool according to claim 10, wherein the inlet (33) is formed by an axial through-channel (64) formed in the static body (35) and having at an end thereof remote from the metering chamber (31) a nozzle opening (65).

13. A setting tool according to claim 12, wherein the metering device (30) comprises valve means for controlling flow through the axial through-channel (64) and including a valve rod (69) displaceable through a passage (40) formed in the displaceable piston body (34) and a pot space (30) thereof and having a valve head (68), and a valve seat (67) provided at an opening of the through-channel (64) adjacent to the metering chamber (31) for sealingly receiving the valve head (68).

* * * * *